US007698844B2

(12) United States Patent
Gruber et al.

(10) Patent No.: US 7,698,844 B2
(45) Date of Patent: Apr. 20, 2010

(54) BOX MAGAZINE FOR A FIREARM

(75) Inventors: Josef Gruber, Haidershofen (AT); Hubert Kefer, Bad Ischl (AT)

(73) Assignee: STEYR MANNLICHER Holding GmbH, Kleinraming (AT)

( * ) Notice: Subject to any disclaimer, the term of this patent is extended or adjusted under 35 U.S.C. 154(b) by 0 days.

(21) Appl. No.: 12/094,307

(22) PCT Filed: Nov. 24, 2006

(86) PCT No.: PCT/AT2006/000484

§ 371 (c)(1),
(2), (4) Date: May 20, 2008

(87) PCT Pub. No.: WO2007/059549

PCT Pub. Date: May 31, 2007

(65) Prior Publication Data

US 2008/0313946 A1 Dec. 25, 2008

(30) Foreign Application Priority Data

Nov. 25, 2005 (AT) ..... A 1908/2005

(51) Int. Cl.
*F41A 9/65* (2006.01)

(52) U.S. Cl. ..... 42/50

(58) Field of Classification Search ..... 42/18, 42/50, 49.01, 49.02
See application file for complete search history.

(56) References Cited

U.S. PATENT DOCUMENTS

| | | | | |
|---|---|---|---|---|
| 2,828,568 | A * | 4/1958 | Sakewitz | 42/50 |
| 3,732,643 | A * | 5/1973 | Wells | 42/50 |
| 4,069,608 | A | 1/1978 | Jurek | |
| 4,079,535 | A * | 3/1978 | Elbe et al. | 42/49.02 |
| 4,314,419 | A * | 2/1982 | Koon, Jr. | 42/50 |
| 4,688,344 | A * | 8/1987 | Kim | 42/50 |
| 4,888,900 | A | 12/1989 | Howard | |
| 4,901,463 | A * | 2/1990 | Chesnut | 42/50 |
| 5,149,897 | A * | 9/1992 | Howard | 42/50 |
| 5,309,660 | A * | 5/1994 | Blackamore | 42/50 |
| 5,755,052 | A * | 5/1998 | Keeney | 42/50 |
| 7,398,615 | B2 * | 7/2008 | Wheatley | 42/49.01 |

FOREIGN PATENT DOCUMENTS

| | | |
|---|---|---|
| CZ | 10068 | 6/2000 |
| DE | 1094155 | 12/1960 |
| FR | 755369 | 11/1933 |
| GB | 406885 | 3/1934 |

OTHER PUBLICATIONS

International Preliminary Examination Report dated Sep. 12, 2008.

* cited by examiner

*Primary Examiner*—Michael Carone
*Assistant Examiner*—Reginald Tillman, Jr.
(74) *Attorney, Agent, or Firm*—Hoffmann & Baron, LLP

(57) ABSTRACT

Rod magazine for a firearm, having a channel for holding cartridges in a stack, and having a feed for feeding the stack to a channel end which is clasped by magazine lips, which hold the top cartridge in the stack back in the channel direction, but allow its movement approximately transversely with respect to the channel direction beyond the rod magazine, with the channel being equipped with guide strips, which run in the channel direction, for the shoulders of the cartridges, and with the guide strips projecting beyond the channel end and into the movement path, which is located in front of the magazine lips, of the top cartridge.

7 Claims, 5 Drawing Sheets

BOX MAGAZINE FOR A FIREARM

BACKGROUND OF THE INVENTION

The present invention relates to a rod magazine for a firearm, having a channel for holding cartridges in a stack and having a feed for feeding the stack to a channel end which is overlapped by magazine lips which hold the top cartridge in the stack back in the channel direction, but allow it to move approximately transversely with respect to the channel direction beyond the rod magazine, with the channel being equipped with guide strips, which run in the channel direction, for the shoulders of the cartridges.

FIGS. 1 to 3 show a rod magazine 1 such as this according to the prior art in the form of a perspective view (FIG. 1) and in two different operating positions, in the form of a section, in conjunction with a repeating rifle 2, a detail of which is illustrated (FIGS. 2, 3) . The rod magazine 1 has a channel 3 for holding cartridges 4, 4' in a stack. Side guide strips 5 in the channel 3 act as a stop for the shoulders of the cartridges 4, 4' and as sliding aids during their movement upwards. A feeder 6 which is loaded by a magazine spring (not shown) feeds the stack to the channel end 7.

In its rearward part, the channel end 7 is overlapped by magazine lips 8 which hold the respective top cartridge 4 in the stack back in the channel direction (at the top in the illustrated example), but at the same time allows movement of the cartridge 4 approximately transversely with respect to the channel direction (to the left in the illustrated example) beyond the rod magazine, in order to load the rifle 2. For this purpose, an attachment 9 on the breech 10 engages between the magazine lips 8 and acts on the bottom of the cartridge 4 in order to insert it into the firing chamber 11 of the barrel 12, by a forward movement of the breech 10.

As FIGS. 2 and 3 show, the head or the neck of the cartridge 4 during this process runs on guide edges 13, 14 of the firing chamber 11, which can lead to slight deformation and asymmetry of the cartridge, adversely affecting the firing accuracy.

It has therefore already been proposed to use rod magazines which are matched to the respective weapon and to the respectively used cartridge caliber, in order to minimize the risk of deformation of cartridges during loading. However, the known designs are always restricted to the specific weapon/magazine/caliber combinations.

The object of the invention is to overcome the described disadvantages of the prior art and to provide a rod magazine for a firearm, which allows cartridges to be fed better, including cartridges of different caliber.

SUMMARY OF THE INVENTION

The foregoing object is achieved by a rod magazine of the type mentioned in the introduction which, according to the invention, is characterized in that the guide strips project beyond the channel end and into the movement path, in front of the magazine lips, of the top cartridge.

This results in the guide strips of the magazine channel being used at the same time for feeding the cartridges to the firing chamber. The cartridges slide onto the projecting ends of the guide strips and are aligned obliquely upwards and with respect to the firing chamber in this way, without touching the edges of the firing chamber. This reliably avoids deformation of the cartridge during the loading process.

Furthermore, all that is necessary for use of cartridges of different caliber is to match the guide strips to the appropriate caliber. Rod magazines can therefore be manufactured for a wide range of calibers with one and the same magazine body and different guide strips. This simplifies the manufacturing logistics, allows larger batch sizes with parts such as the magazine channel, feed, magazine spring, magazine base, etc. remaining the same, and therefore achieves a significant cost reduction for the manufacture of magazines for different calibers.

The guide strips are preferably manufactured from metal or plastic. In the former case, this provides good wear resistance, and in the latter case it reduces the risk of damage to the cartridges even further.

One preferred embodiment of the invention is distinguished in that the end surfaces of the guide strips are inclined, and they project to a continuously greater extent as seen in the direction of the movement path. This further reduces the friction of the cartridges while they are sliding.

It is particularly advantageous for it to be possible to anchor the guide strips as separate modules in the channel and for then preferably to be interchanged in a modular manner. This allows the manufacturing logistics to be simplified even further on the basis of the modular combination of guide strips with magazine bodies; modular interchangeability also allows the user to adapt the caliber of the magazine by replacement of the guide strips.

In this case, it is particularly advantageous for at least one of the guide strips to have an inscription base on its outside, which can be seen from the outside through an opening in the channel. This allows a caliber identification to be applied to the guide strips, which can be read from outside on the magazine thus preventing confusion between magazines with different guide strips for different calibers.

According to a further preferred feature of the invention, the guide strips are integrally connected to one another via a common web, thus simplifying the manufacture of the guide strips and their installation in the channel.

The guide strips, which are connected to one another via the web, are preferably in this case anchored by means of projections in openings or notches in the channel, thus allowing particularly simple and quick assembly.

BRIEF DESCRIPTION OF THE DRAWINGS

The invention will be explained in more detail in the following text with reference to exemplary embodiments which refer to the attached FIGS. 4 to 13, in which.

DETAILED DESCRIPTION

Figure 1:
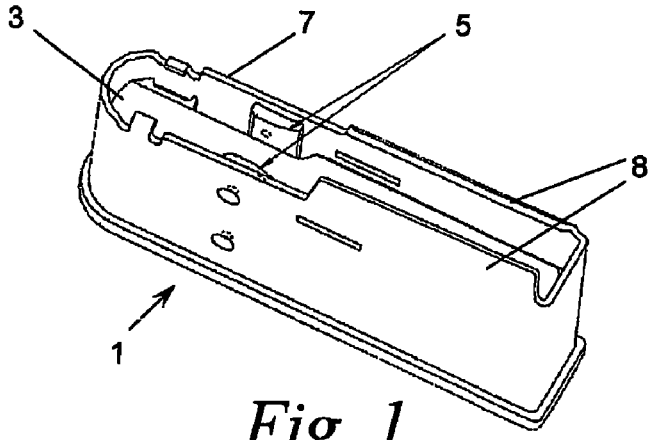
Fig. 1 (Prior art)
FIGS. 1 to 3 show a rod magazine according to the prior art as described above.
Figure 2:
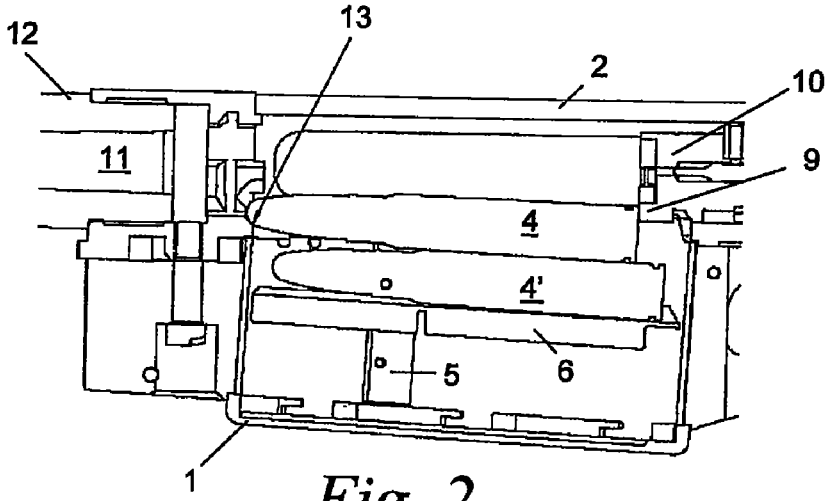
Fig. 2 (Prior art)
Figure 3:
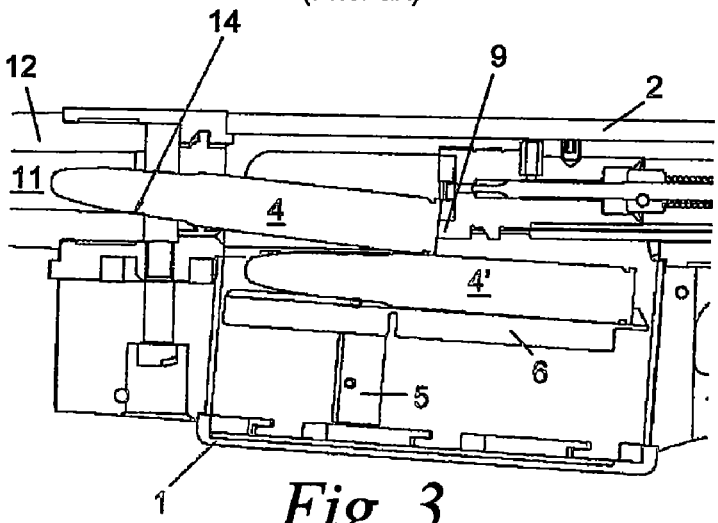
Fig. 3 (Prior art)

The rod magazine 15 illustrated in FIGS. 4 to 13 essentially corresponds to the rod magazine 1 shown in FIGS. 1 to 3, with the exception of its guide strips 16 and the details which will be described in the following text, with the same reference symbols being used in FIGS. 4 to 13 for the same parts as in FIGS. 1 to 3. References should therefore be made to the description of the corresponding parts of the rod magazine 1 for an explanation of these parts of the rod magazine 15.

The guide strips 16 of the rod magazine 15 are extended beyond the channel end 7, so that they project into the movement path, in front of the magazine lips 8, of the top cartridge 4. The end surfaces 17 of the guide strips 16 run at a slight angle, to be precise such that they project to a continuously greater extent as seen in the direction of the movement path the cartridge 4. The end surfaces 17 therefore result in the top cartridge 4 sliding and being slightly tilted upwards during the loading process, as will now be explained in more detail with reference to FIGS. 10 to 12.

Figure 10:
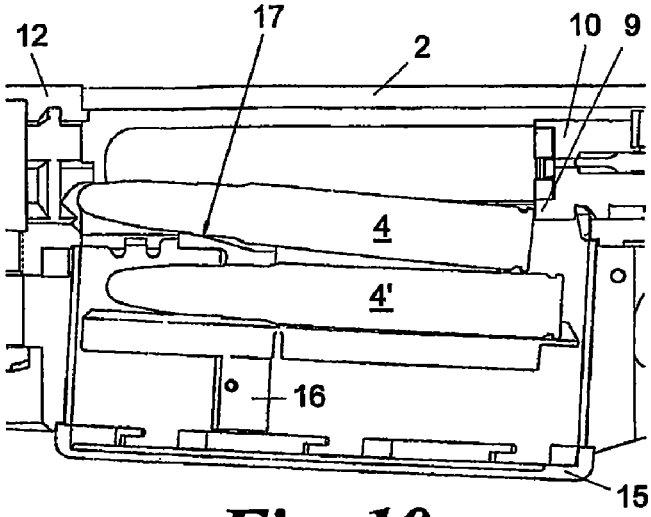
FIGS. 10 to 12 show the rod magazine according to the invention in the form of a section, in three successive operating positions during loading of a cartridge, to be precise in each case in conjunction with a repeater rifle, which is illustrated in the form of a detail.
Figure 11:
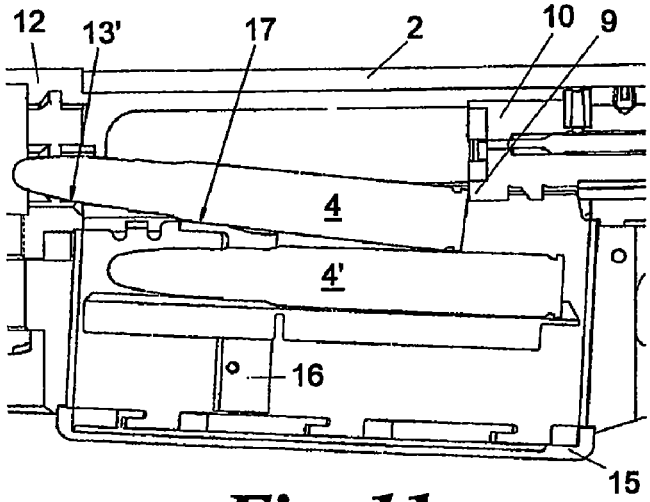
Figure 12:
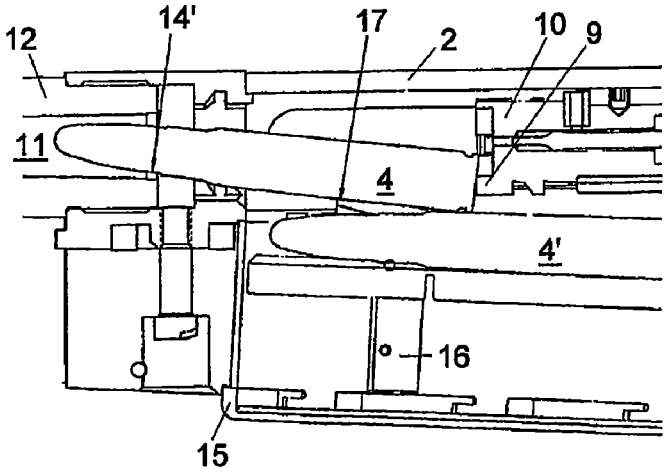

FIGS. 10 to 12 show the movement of the cartridge 4 during the loading process. The cartridge 4 slides over the inclined end surfaces 17 of the guide strips 16 into the firing chamber 11. The end surfaces 17 are for this purpose matched to the external contour of the cartridges 4, as can be seen in particular in FIGS. 7 and 8. The cartridge 4 therefore remains free of the edges 13, 14 of the firing chamber 11 while it is being inserted into the firing chamber 11, as indicated at 13' and 14'.

Figure 4:
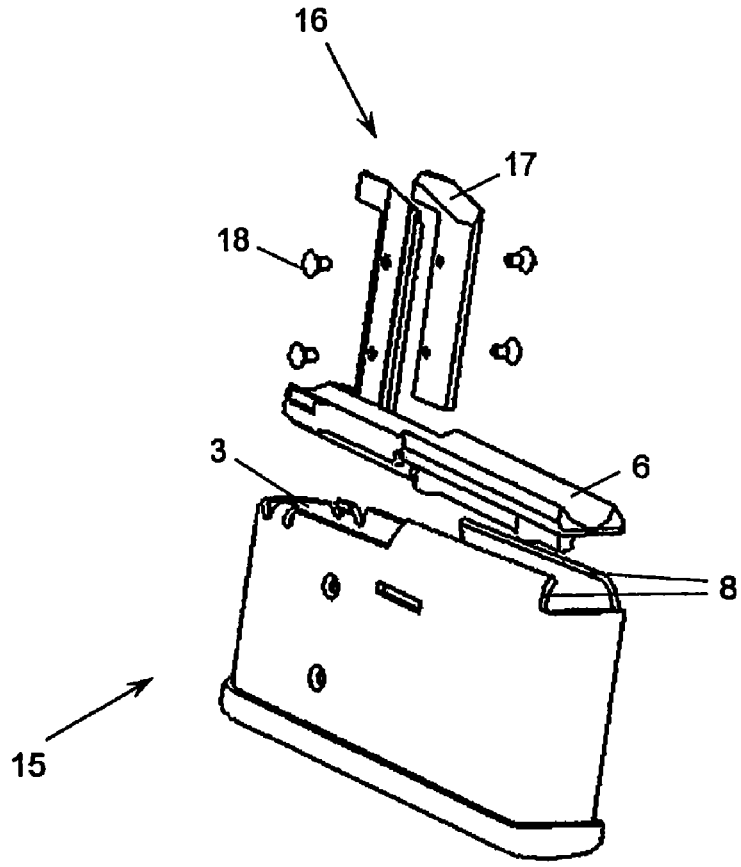
FIGS. 4 and 5 show the rod magazine according to the invention in an exploded perspective view and in the form of an assembled perspective view.
Figure 5:
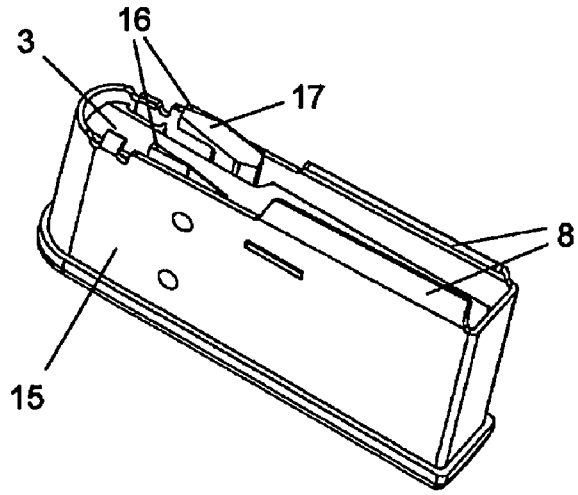
Figure 6:
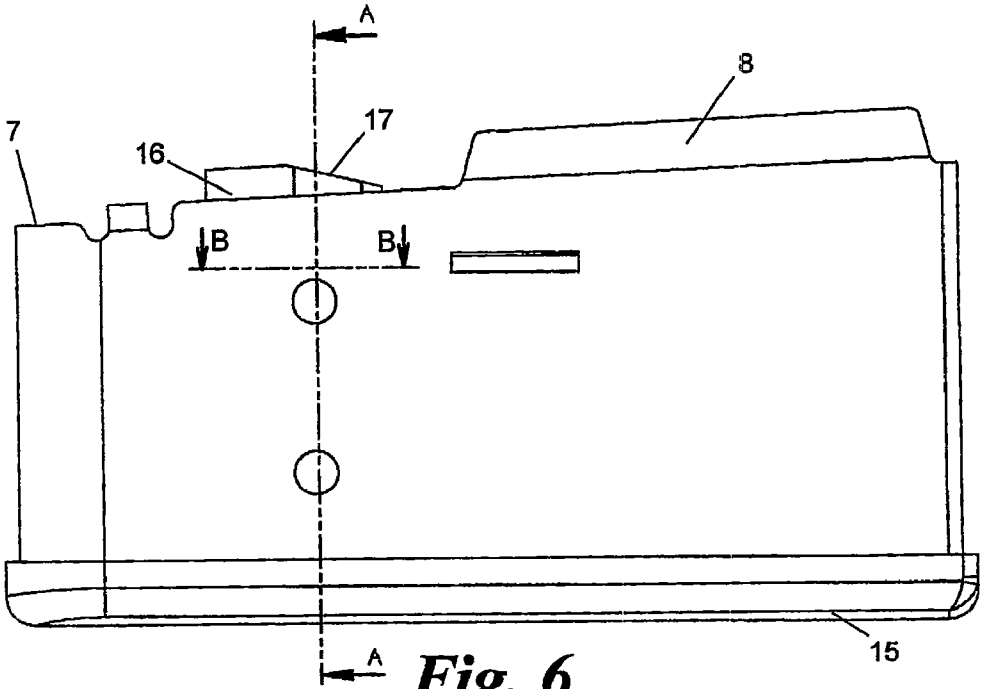
FIGS. 6 and 7 show the rod magazine according to the invention in the form of a side view and a plan view, respectively.
Figure 7:
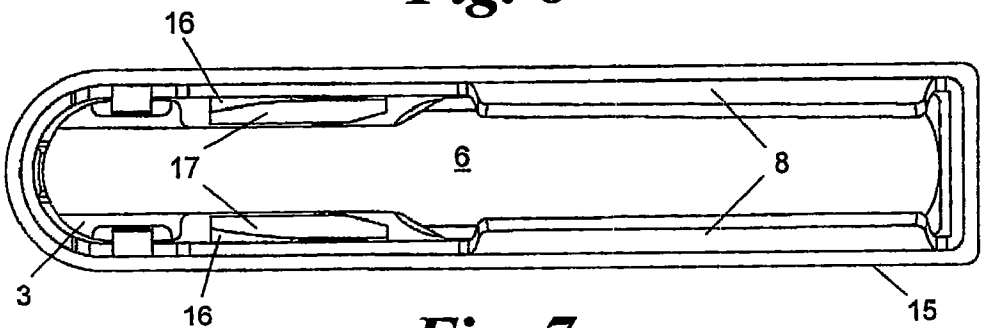
Figure 8:
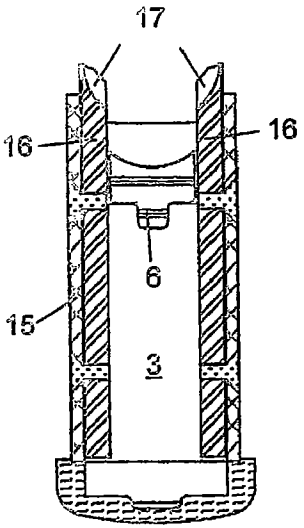
FIG. 8 shows a section along the line A-A from FIG. 6.
Figure 9:
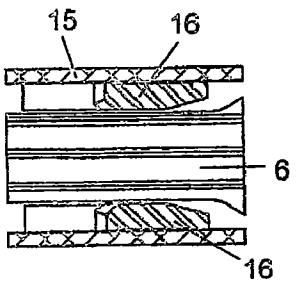
FIG. 9 shows a section, in the form of a detail, along the line B-B from FIG. 6.

The guide strips 16 are preferably manufactured from plastic and are attached in any desired manner to the inner walls of the channel 3, for example by screwing, adhesive bonding, soldering or riveting, see the examples of blind rivets 18 in FIG. 4.

The guide strips 16 may either be anchored firmly in the channel 3, or else may be anchored in the channel 3 such that they can be interchanged in a modular manner.

Figure 13:
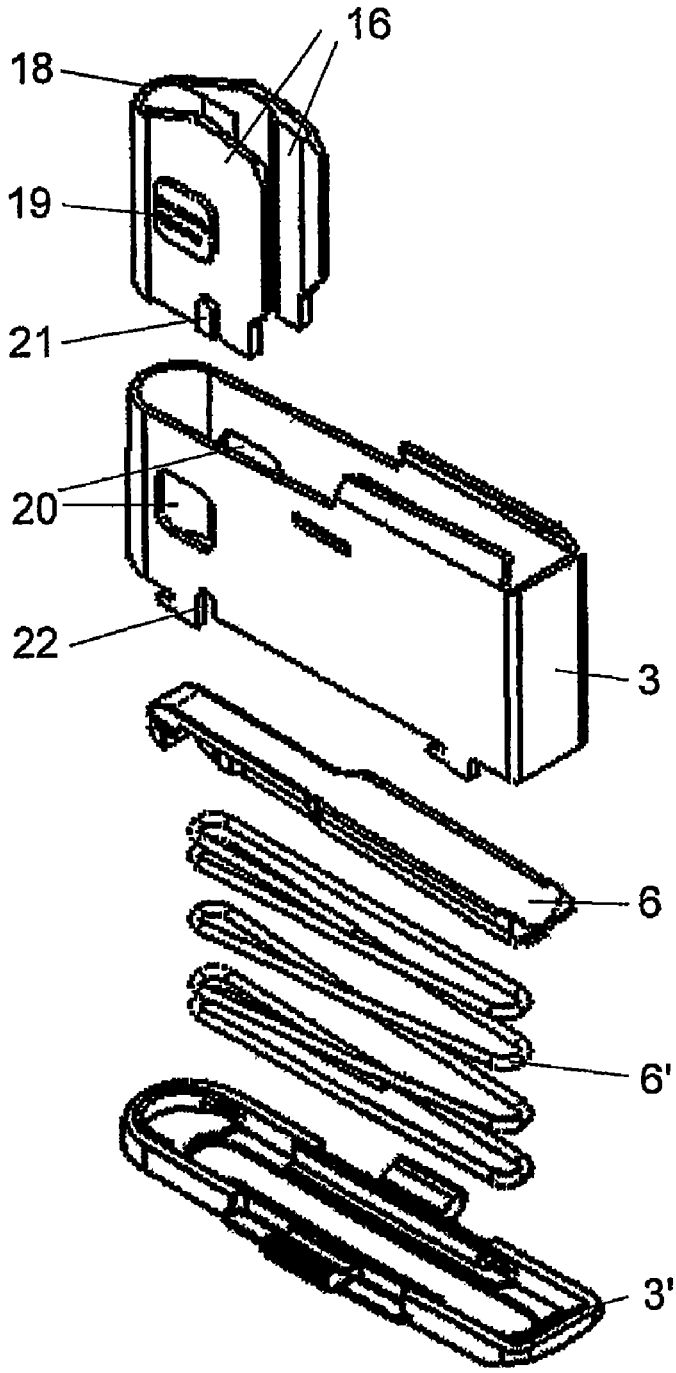
FIG. 13 shows an alternative embodiment of the guide strips for the rod magazine according to the invention.

FIG. 13 shows an alternative embodiment of the guide strips 16, which differs from that shown in FIGS. 4 to 12 in that the two guide strips 16 are integrally connected to one another via a common, preferably elastic, web 18 which is integral with the inner wall of the channel 3. Furthermore, on its outside facing the channel, each guide strip 16 has an inscription base 19 which can be seen from the outside through appropriate openings 20 in the channel 3. The identification of the cartridge caliber to which the guide strips 16 are matched can be applied to the inscription base 19.

FIG. 13 also shows the magazine spring 6' of the feed 6 as well as the base 3' of the channel 3 in detail.

As illustrated, the inscription bases 19 may form projections on the outside of the guide strips 16 so that, using the spring effect of the web 18, they latch into the openings 20 during insertion of the guide strips 16 into the channel 3, and therefore anchor the guide strips 16 in the channel 3. Alternatively or additionally, further projections 21 can be provided for anchorage purposes on the guide strips 16, and corresponding notches 22 can be provided in the channel 3, and, for example—if the web 18 is not elastic and the inscription bases 19 do not project—also allow insertion of the guide strips 16, which are connected via the web 18 into the channel 3 from underneath before the base 3' is fitted.

The invention is not restricted to the described embodiments, but covers all variants and modifications which are within the scope of the attached claims.

The invention claimed is:

1. A rod magazine for a firearm, comprising a channel for holding cartridges in a stack and having a feed for feeding the stack to a channel end which is overlapped by magazine lips which hold a top cartridge in the stack back in a channel direction but allow the top cartridge to move approximately transversely with respect to the channel direction beyond the rod magazine, wherein the channel has opposed guide strips which run in the channel direction for shoulders of the cartridges, wherein the opposed guide strips project beyond the channel end and into a movement path in front of the magazine lips of the top cartridge, said movement path being substantially transverse to the channel direction.

2. The rod magazine as claimed in claim 1, wherein the guide strips are manufactured from one of metal and plastic.

3. The rod magazine as claimed in claim 1, wherein the guide strips have top end surfaces which are inclined and project to a continuously greater extent as seen in a direction of the movement path.

4. The rod magazine as claimed in claim 1, wherein the guide strips can be anchored as separate modules in the channel and can be interchanged in a modular manner.

5. The rod magazine as claimed in claim 1, wherein at least one of the guide strips has an inscription base on its outside, which can be seen from the outside through an opening in the channel.

6. The rod magazine as claimed in claim 1, wherein the guide strips are integrally connected to one another via a common web.

7. The rod magazine as claimed in claim 1, wherein the guide strips are anchored.

* * * * *